US009618871B2

(12) United States Patent
Murata et al.

(10) Patent No.: US 9,618,871 B2
(45) Date of Patent: Apr. 11, 2017

(54) IMAGE FORMING APPARATUS

(71) Applicant: KYOCERA Document Solutions Inc., Osaka (JP)

(72) Inventors: Takahiko Murata, Osaka (JP); Hisashi Mukataka, Osaka (JP); Masaki Kadota, Osaka (JP); Ai Takagami, Osaka (JP); Maki Ike, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 32 days.

(21) Appl. No.: 15/087,248

(22) Filed: Mar. 31, 2016

(65) Prior Publication Data

US 2016/0320720 A1 Nov. 3, 2016

(30) Foreign Application Priority Data

Apr. 28, 2015 (JP) ..... 2015-091484
Mar. 22, 2016 (JP) ..... 2016-056418

(51) Int. Cl.
*G03G 15/02* (2006.01)

(52) U.S. Cl.
CPC ..... *G03G 15/0266* (2013.01)

(58) Field of Classification Search
None
See application file for complete search history.

(56) References Cited

U.S. PATENT DOCUMENTS

2007/0019989 A1 1/2007 Nakamori ..... 399/159
2010/0178070 A1* 7/2010 Yamada ..... G03G 21/0011 399/44
2011/0268466 A1* 11/2011 Kimura ..... G03G 15/757 399/71
2012/0196213 A1* 8/2012 Aoyagi ..... G03G 15/505 430/56

(Continued)

FOREIGN PATENT DOCUMENTS

JP 2006234894 A * 9/2006
JP 2007-25270 A 2/2007
JP 2007-108421 A 4/2007

(Continued)

OTHER PUBLICATIONS

Machine translations of Maruyama (2006) and Toda (2012).*

*Primary Examiner* — Sevan A Aydin
(74) *Attorney, Agent, or Firm* — Stein IP, LLC

(57) ABSTRACT

An image forming apparatus includes an image carrying member, a driving device, a charging member, a cleaning member, a voltage applying device, a torque detector for detecting the torque of the driving device, a storage for storing a predetermined torque value Tc, and a control portion. The control portion obtains as Ton the torque when the charging voltage is applied to the charging member and obtains as Toff the torque when no charging voltage is applied to the charging member. Let the torque observed when no charging voltage is applied at an early stage of use of the image carrying member be represented by Toff(0), then, when the relations Toff(0)<Toff and Tc<Ton/Toff hold, (Continued)

the control portion determines that the degree of smoothness of the surface of the image carrying member is equal to or higher than a predetermined degree of smoothness.

8 Claims, 4 Drawing Sheets

(56) References Cited

U.S. PATENT DOCUMENTS

| | | | | |
|---|---|---|---|---|
| 2014/0270880 | A1* | 9/2014 | Klenkler ..... | G03G 21/0094 399/346 |
| 2015/0023682 | A1* | 1/2015 | Yuasa ..... | G03G 21/0094 399/71 |

FOREIGN PATENT DOCUMENTS

| | | | | |
|---|---|---|---|---|
| JP | 2010060680 | A | * | 3/2010 |
| JP | 2012185198 | A | * | 9/2012 |

* cited by examiner

IMAGE FORMING APPARATUS

INCORPORATION BY REFERENCE

This application is based upon and claims the benefit of priority from the corresponding Japanese Patent Application No. 2015-091484 filed on Apr. 28, 2015, and Japanese Patent Application No. 2016-056418 filed on Mar. 22, 2016, the entire contents of both of which are incorporated herein by reference.

BACKGROUND

The present disclosure relates to an image forming apparatus which forms an image on a recording sheet. More particularly, the present disclosure relates to a method for checking the condition of the surface of an image carrying member on the surface of which a toner image is formed.

Among image forming apparatuses such as printers, copiers, facsimile machines, multifunction peripherals having the functions of more than one of them, etc., some are known which are provided with a photosensitive drum as an example of an electrophotographic photosensitive member, a charging member such as a charging roller which electrostatically charges the surface of the photosensitive drum, and a cleaning blade which is arranged in contact with the surface of the photosensitive drum and which removes toner or external additive left unused on the surface of the photosensitive drum.

Such a charging member is arranged in contact with or close to the image carrying member and discharge products produced due to electric discharge by the charging member attach to the surface of the image carrying member. This increases the friction resistance between the surface of the image carrying member and the cleaning blade, and makes the cleaning blade more likely to suffer from chatter, tears, and stick-slip, resulting in degraded cleaning performance of the cleaning blade. As a result, with an increased slipping amount of toner and external additive, the charging member is contaminated, and toner and external additive left uncleaned are fixed to the surface of the image carrying member, resulting in image quality degradation and image formation defects.

In particular, when an image carrying member having on its surface an amorphous silicon layer formed as a photosensitive layer is used, at an early stage after the start of use, owing to surface irregularities ascribable to crystal particles produced when the amorphous silicon layer is formed, the contact area is small between the surface of the image carrying member and the cleaning blade, and thus the friction resistance between them is also small; however, as the image carrying member continues being used, the irregularities on the surface of the image carrying member wear and smoothen, with the result that the friction resistance increases between the surface of the image carrying member and the cleaning blade, making the previously mentioned problems more likely to occur.

As a solution, there have been known approaches that involve, with a view to reducing the load of the cleaning blade, feeding toner as a lubricant, reducing the charging voltage, and so forth, thereby to suppress production of discharge products.

SUMMARY

According to one aspect of the present disclosure, an image forming apparatus includes an image carrying member, a driving device, a charging member, a cleaning member, a voltage applying device, a torque detector, a storage, and a control portion. A toner image is formed on the surface of the image carrying member. The driving device drives the image carrying member to rotate. The charging member electrostatically charges the image carrying member. The cleaning member is arranged in contact with the surface of the image carrying member for cleaning the surface of the image carrying member. The voltage applying device applies a charging voltage to the charging member. The torque detector detects the torque of the driving device when the driving device drives the image carrying member to rotate. The storage stores a predetermined torque value Tc which relates to the torque of the driving device and which is a constant larger than one. The control portion checks condition of the surface of the image carrying member based on the torque of the driving device detected by the torque detector. The control portion obtains as Ton the torque detected by the torque detector when the charging voltage is applied and obtains as Toff the torque detected by the torque detector when no charging voltage is applied. Let the torque observed when no charging voltage is applied at an early stage of use of the image carrying member be represented by Toff(0), then, when relations Toff(0)<Toff and Tc<Ton/Toff hold, the control portion determines that the degree of smoothness of the surface of the image carrying member is equal to or higher than a predetermined degree of smoothness.

Further features and advantages of the present disclosure will become apparent from the description of embodiments given below.

DETAILED DESCRIPTION

Figure 1:
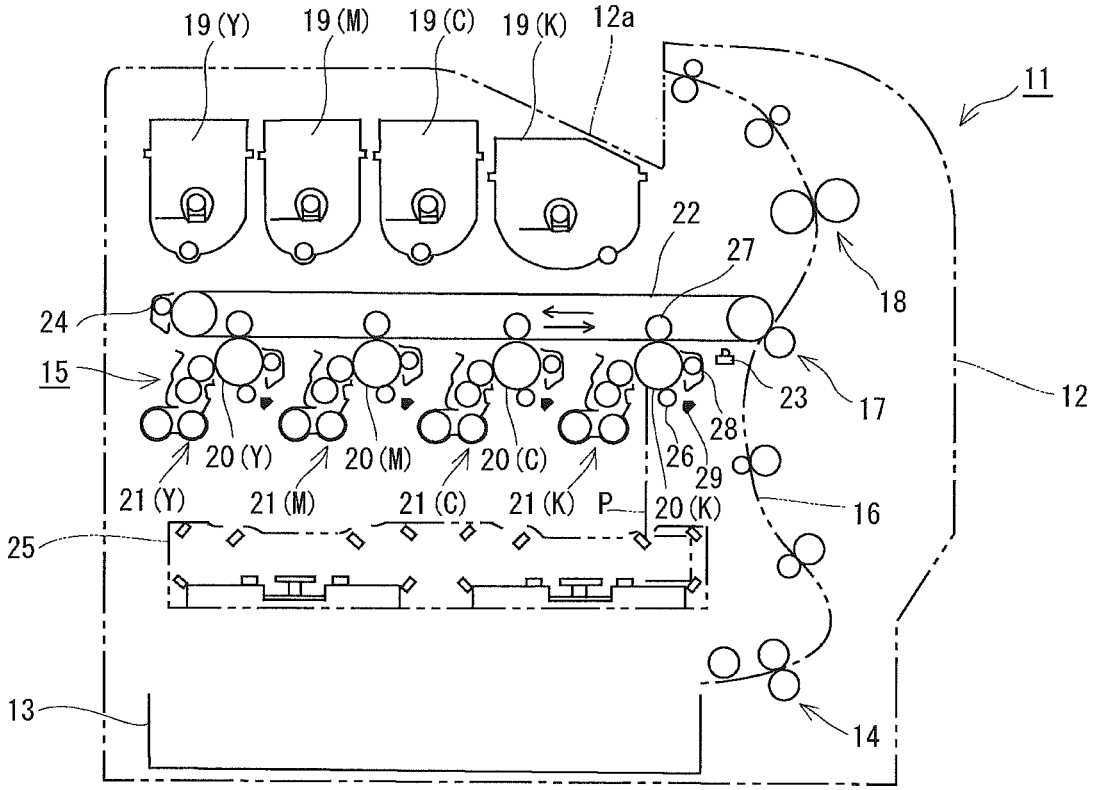
FIG. 1 is a schematic sectional view showing an outline of the construction of a tandem-type color printer as an image forming apparatus 11 according to one embodiment of the present disclosure.
Figure 2:
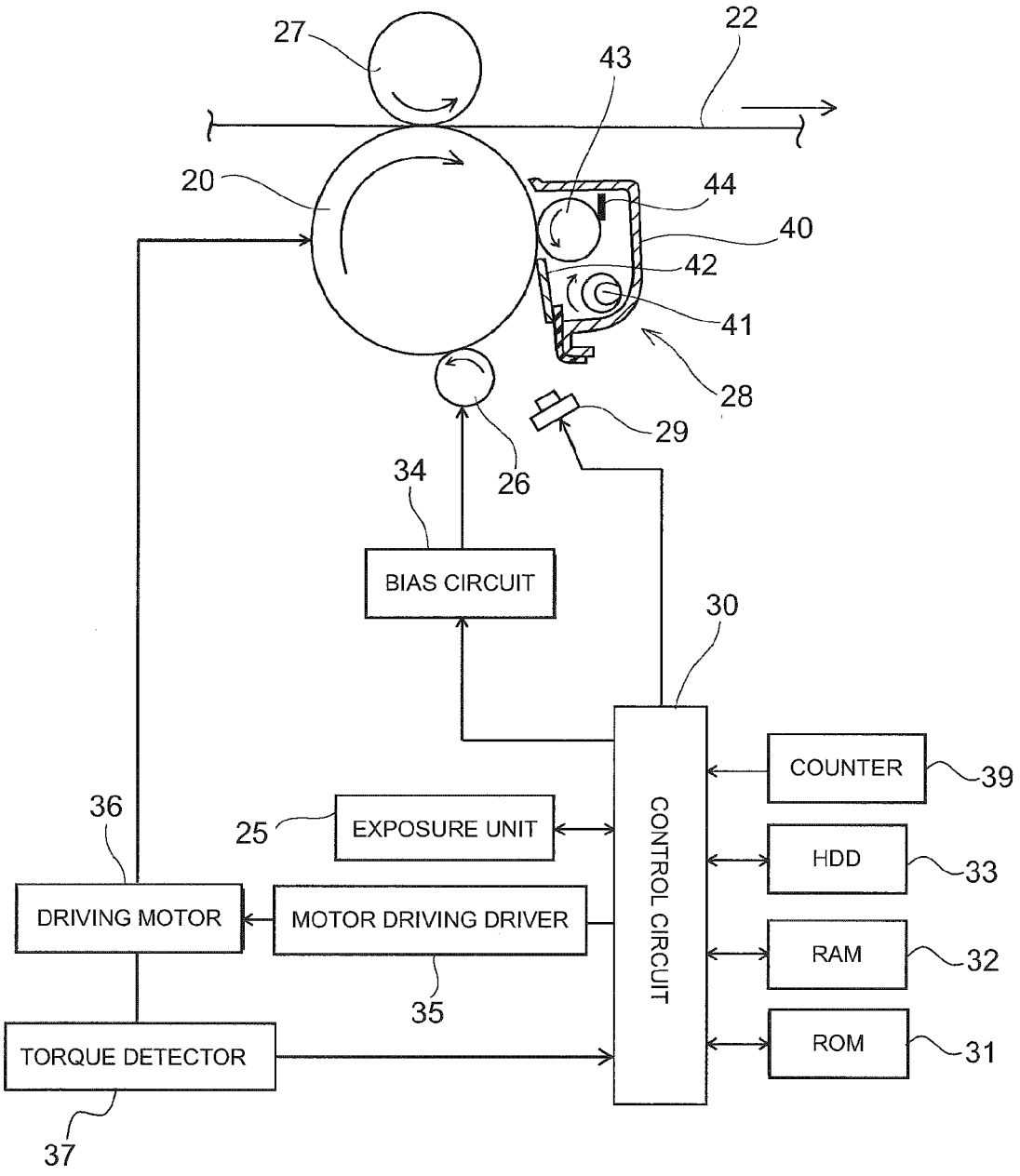
FIG. 2 is a view showing an outline of the structure of a main part, including an image formation processing section 15, of an image forming apparatus 11 according to the embodiment.

Hereinafter, embodiments of the present disclosure will be described with reference to the accompanying drawings. FIG. 1 is a schematic sectional view showing an outline of the construction of an image forming apparatus 11 according to one embodiment of the present disclosure. FIG. 2 is a view showing an outline of the structure of a main part, including an image formation processing section 15, of the image forming apparatus 11 shown in FIG. 1.

1. Construction of Image Forming Apparatus 11

Overall Construction

As shown in FIG. 1, the image forming apparatus 11 according to the present embodiment is a tandem-type color printer. The image forming apparatus 11 includes, inside a printer body 12, a sheet feed cassette 13 for storing recording sheets (unillustrated), a sheet feeding portion 14 for feeding one recording sheet after another from the sheet feed cassette 13, an image formation processing section 15 for forming an image on a recoding sheet fed from the sheet feed cassette 13 or from a manual feed tray (unillustrated), a recording sheet transport passage 16 for transporting the recording sheet fed from the sheet feed cassette 13 or from the manual feed tray, a secondary transfer portion 17 for transferring a toner image formed in the image formation processing section 15 to the recording sheet transported along the recording sheet transport passage 16, and a fixing portion 18 for fixing the toner image transferred to the recording sheet in the secondary transfer portion 17.

Structure of Image Formation Processing Section 15

The image formation processing section 15 adopts, for example, a tandem system in which an image formation process is executed by use of toner (developer) of four colors, namely yellow (Y), magenta (M), cyan (C), and black (K). In the following description, a reference numeral is accompanied by an indication of color in parentheses (Y, M, C, or K) only when the ongoing description applies to a particular color; where the ongoing description applies to all colors, a reference numeral stands alone.

The image formation processing section 15 includes, so as to correspond to different colors (Y, M, C, and K), a plurality of toner containers 19 for storing toner for replenishment, a plurality of photosensitive drums 20 for forming toner images of the different colors based on print data (image data) transmitted from an externally connected device such as a personal computer, a plurality of developing devices 21 for feeding toner to the photosensitive drums 20, an endless intermediate transfer belt 22 for primarily transferring thereto the toner images formed on the photosensitive drums 20, a belt cleaning device 24 for removing unused toner and the like attached on the surface of the intermediate transfer belt 22, the belt cleaning device 24 being located on the upstream side of the photosensitive drum 20 of the most upstream-side intermediate transfer belt 22 with respect to its rotation movement direction, and an exposure unit 25 for irradiating the photosensitive drums 20 with light beams.

Structure of Photosensitive Drum 20

The photosensitive drum 20 has a photosensitive layer formed on the surface of a support (base body). Here, the photosensitive drum 20 is composed of a cylindrical metal tube and a photosensitive layer formed on the surface of the tube. Examples of metals for forming the tube include aluminum, iron, titanium, magnesium, etc. As the photosensitive layer, an organic photosensitive layer formed of an organic photoconductor or an inorganic photosensitive layer formed of an inorganic photoconductor, or the like can be used, and preferable is an amorphous silicon photosensitive layer formed by vapor deposition of silane gas or the like, for its high durability. The photosensitive drums 20, based on the light beams emitted from the exposure unit 25 to their surfaces, carry toner images of the different colors so as to transfer the toner images to the intermediate transfer belt 22, and are, as shown in FIG. 1, arranged together with the developing devices 21 under the intermediate transfer belt 22.

As shown in FIGS. 1 and 2, there are arranged, around the photosensitive drum 20, a charging roller (charging member) 26, an exposure unit 25, a developing device 21, a cleaning device 28, and a destaticizer 29. Across the intermediate transfer belt 22, a primary transfer roller 27 is arranged opposite the photosensitive drum 20.

Toner images transferred to the intermediate transfer belt 22 in primary transfer portions which are constituted by cooperation between the photosensitive drums 20 and the primary transfer roller 27 are transferred in the secondary transfer portion 17 to the recording sheet transported through the recording sheet transport passage 16 from the sheet feed cassette 16 or from the manual feed tray.

Structure of Developing Device 21

The developing devices 21 having basically the same structure are aligned under the intermediate transfer belt 22 along its rotation movement direction. The developing device 21 develops into a toner image the electrostatic latent image formed on the surface of the photosensitive drum 20 by attaching toner containing a toner external additive (abrasive particles) comprising metal particles such as titanium oxide. As the developing device 21, a conventionally well-known one can be used.

Structure of Intermediate Transfer Belt 22

The intermediate transfer belt 22 is an endless belt wound, under tension, around a driving roller and a following roller in the horizontal direction in the printer body 12, and is driven to rotate as the driving roller is rotated by a belt driving motor (unillustrated) as image formation proceeds.

Structure of Charging Roller 26

The charging roller 26 is formed of, for example, electrically conductive rubber, and is arranged in contact with the photosensitive drum 20. As shown in FIG. 2, as the photosensitive drum 20 rotates in the clockwise direction, the charging roller 26 in contact with the surface of the photosensitive drum 20 follows this by rotating in the counter-clockwise direction. Here, applying a predetermined voltage to the charging roller 26 allows the surface of the photosensitive drum 20 to be electrostatically charged uniformly. As the charging roller 26 rotates, a charging roller cleaning roller (unillustrated) in contact with the charging roller 26 is driven to rotate in the clockwise direction to remove foreign matter attached to the surface of the charging roller 26. Here, the charging roller 26 may be arranged close to the photosensitive drum 20.

Structure of Cleaning Device 28

The cleaning device 28 includes a cleaning housing 40 which has a depth in the recording sheet width direction (direction orthogonal to the recording sheet transport direction), a collection spiral 41 which is arranged inside the cleaning housing 40 in a lower part of it and which transports, while rotating in the clockwise direction in FIG. 2, collected toner to one side in the recording sheet width direction so as to feed the toner to a waste toner container (unillustrated), a cleaning blade 42 which is fitted outside the cleaning housing 40 in a lower part of it, a rubbing roller (cleaning roller) 43 which is arranged inside the cleaning housing 40 in an upper part of it so as to be in contact with the surface of the photosensitive drum 20, and a scraper 44 which is arranged over the rubbing roller 43 so as to be in contact with the surface of the rubbing roller 43.

The cleaning blade 42 is formed of urethane rubber or the like. The cleaning blade 42 is arranged so that its tip end makes contact with the surface of the photosensitive drum 20 from below the rotary axis of the photosensitive drum 20. Here, the tip end of the cleaning blade 42 makes contact with the photosensitive drum 20 from a direction counter to its rotation direction (see the arrow in FIG. 2).

The rubbing roller 43, while collecting waste toner from the surface of the photosensitive drum 20, polishes the surface of the photosensitive drum 20 by use of the waste toner attached to the surface of the rubbing roller 43. To that end, the rubbing roller 43 has to have a high waste toner holding ability, and to achieve that, it is formed of foam rubber (for example, carbon containing electrically conductive EPDM foam) in a cylindrical shape extending in the recording sheet width direction, and is arranged on the upstream side of the tip end of the cleaning blade 42 with respect to the rotation direction of the photosensitive drum 20. The rotation direction of the rubbing roller 43 is opposite to the rotation direction of the photosensitive drum 20. The scraper 44 is formed of a thin metal plate that has sufficient durability, and its tip end makes contact with the rubbing roller 43, on the downstream side thereof with respect to its rotation direction, from a direction counter to it so as to make uniform the amount of toner attached to the surface of the rubbing roller 43.

Structure of Destaticizer 29

The destaticizer 29 is arranged along the rotation direction of the photosensitive drum 20, on the downstream side of the cleaning device 28. The destaticizer 29 comprises an LED (light-emitting diode) and is provided with a reflection plate as necessary. The destaticizer 29 removes, by irradiating the photosensitive drum 20 with destaticizing light (erase light), electrostatic charge from its surface in preparation for the electrostatic charging step in the subsequent image formation.

Structure of Control Circuit 30

A control circuit 30 controls the photosensitive drums 20 based on various control programs relating to image formation in general stored in a ROM 31. In addition, the control circuit 30 executes calibration of developing conditions such as the amount of toner supplied to the developing devices 21 and the voltage applied to the developing devices 21, the voltage applied by a bias circuit 34 which applies a voltage having an AC voltage and a DC voltage superimposed on each other to the charging roller 26, exposure conditions such as the laser power of the laser light P (see FIG. 1) emitted from the exposure unit 25, the amount of erase light from the destaticizer 29, etc.

Moreover, the control circuit 30 controls, via a motor driving driver 35, a driving motor (driving device) 36 which makes the photosensitive drum 20 rotate, and performs image quality degradation suppression control based on the detection value fed from a torque detector 37 which detects the torque of the driving motor 36. The control circuit 30 is fed with the count value from a counter 39 which counts the cumulative number of sheets having undergone image formation.

In this embodiment, the torque detector 37 detects an output electric current from the driving motor 36. That is, in this embodiment, the output current from the driving motor 36 is used as an index representing a torque. A means for detecting the torque of the driving motor 36 is, to prevent the driving motor 36 from receiving an excessive load and thereby being damaged, generally provided in an image forming apparatus.

In the ROM 31, a control program relating to image formation correction according to the present disclosure is also stored; the ROM 31 thus constitutes a microcomputer together with the control circuit 30 which executes the image formation control program. Image data and the like for image formation are temporarily stored in a RAM 32 or in an HDD 33.

2. Procedure for Image Formation

Now, a procedure for image formation in the image forming apparatus 11 will be described. When image data is fed in from an externally connected device such as a personal computer, the surfaces of the photosensitive drums 20 are first electrostatically charged uniformly by the charging rollers 26 and are then irradiated with the laser light P by the exposure unit 25, and thereby electrostatic latent images based on the image data are formed on the photosensitive drums 20. The developing devices 21 are filled with a predetermined amount of two-component developer (hereinafter also referred to simply as developer) containing toner of different colors, namely yellow, magenta, cyan, and black. When the proportion of toner contained in the two-component developer stored in the developing devices 21 falls below a predetermined value through formation of toner images, which will be described later, toner is supplied from the toner containers 19 to the developing devices 21. The toner contained in the developer is fed to the photosensitive drums 20 by the developing devices 21, so that the developer attaches to it electrostatically, and thereby toner images are formed based on the electrostatic latent images formed by exposure to light from the exposure unit 25.

On the other hand, in coordination with toner image formation in the image formation processing section 15, a recording sheet is fed from the sheet feed cassette 13 (or the manual feed tray) and is transported through the recording sheet transport passage 16 to a registration roller pair 30*a*.

Then, by the primary transfer rollers 27, an electric field is applied between the primary transfer rollers 27 and the photosensitive drums 20 with a predetermined transfer voltage, and the toner images of the different colors, namely yellow, magenta, cyan, and black, on the photosensitive drums 20 are primarily transferred to the intermediate transfer belt 22. These four-color images are formed in a predetermined positional relationship so as to form a predetermined full-color image. Thereafter, in preparation for subsequent formation of new electrostatic latent images, toner and the like left unused on the surfaces of the photosensitive drums 20 after the primary transfer are removed by the cleaning devices 28. The residual electric charge on the surfaces of the photosensitive drums 20 is also removed by the destaticizers 29.

As the intermediate transfer belt 22 starts to rotate in the counter-clockwise direction in FIG. 1, the recording sheet is transported with predetermined timing from the registration roller pair 30*a* to the secondary transfer portion 17 arranged next to the intermediate transfer belt 22, and the full-color image on the intermediate transfer belt 22 is secondarily transferred to the recording sheet. The recording sheet to which the toner image has been secondarily transferred is transported to the fixing portion 18. Unused toner and the like attached on the surface of the intermediate transfer belt 22 are removed by the belt cleaning device 24.

The recording sheet transported to the fixing portion 18 is then heated and pressed there, so that the toner image is fixed to the surface of the recording sheet to form the predetermined full-color image. The recording sheet on which the full-color image has been formed is guided to an end part of the recording sheet transport passage 16 and is discharged by a discharge roller pair 30*b* onto a discharge tray 12*a* which doubles as a top surface of the printer body 12.

3. Check on Condition of Surface of Photosensitive Drum 20 by Use of Torque Variation Now, the distinctive features of the image forming apparatus 11 according to the present disclosure will be described. In the above-described configuration, the control circuit 30 performs image formation (a print job) based on various control programs relating to image formation in general stored in the ROM 31, and, while performing it, controls the voltage applied by the bias circuit 34 which applies a voltage having an AC voltage and a DC voltage superimposed on each other to the charging roller 26. The voltage of the DC component of the superimposed voltage is kept constant.

Figure 3:
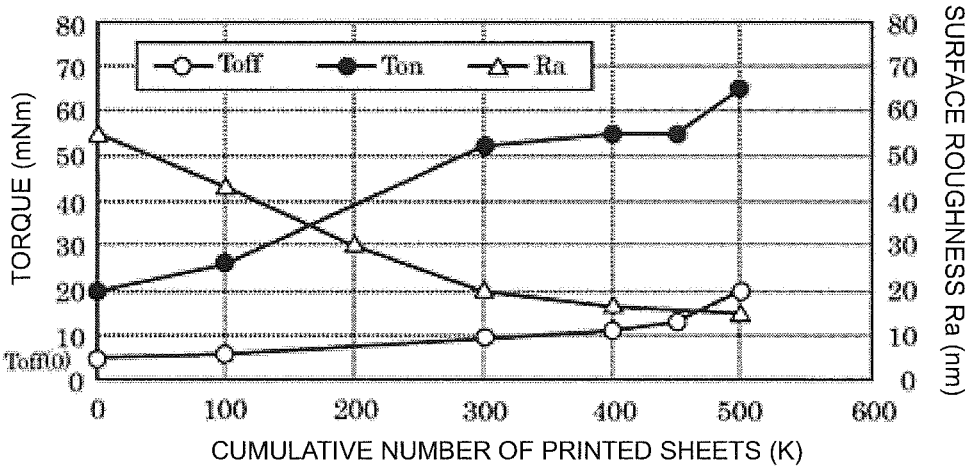
FIG. 3 is a chart showing the relationship of the cumulative number of printed sheets with the torque of a driving motor 36, and with the roughness on the surface of a photosensitive drum 20.

FIG. 3 is a chart showing the relationship between the cumulative number of printed sheets counted from the start of use of the photosensitive drum 20 and the torque of the driving motor 36, and the relationship between the cumulative number of printed sheets and the roughness Ra on the surface of the photosensitive drum 20. Here, the symbol "Ra" refers to the "arithmetic average roughness" prescribed in JIS B0601, 1994.

In FIG. 3, Toff represents a torque when no voltage is applied to the charging roller 26 and Ton represents a torque when a voltage is applied to the charging roller 26. Toff(0) is a Toff value at an early stage of use of the photosensitive drum 20 (in a condition before the start of use, in other words, immediately after factory shipment).

As shown in FIG. 3, as the cumulative number of printed sheets counted from the start of use of the photosensitive drum 20 increases, Toff and Ton all increase. As the cumulative number of printed sheets increases, the surface roughness Ra decreases. The rising speed of Ton is higher than the rising speed of Toff, and thus as the cumulative number of printed sheets increases, the difference between Ton and Toff increases. Especially when the cumulative number of printed sheets is from 100K (sheets) to 300K (sheets), the rising speed of Ton is notably higher than the rising speed of Toff, resulting in a notably increasing difference between Ton and Toff.

In this embodiment, the difference between Ton and Toff is represented by the ratio of Ton to Toff (Ton/Toff), and the value of Ton/Toff when the surface of the photosensitive drum 20 is smoothened is taken as a predetermined torque value Tc. The predetermined torque value Tc is a constant larger than one, previously set with consideration given to the material of the photosensitive drum 20 and its surface roughness before the factory shipment (before the start of use), the materials of the cleaning blade 42 and of the rubbing roller 43, etc., and is stored in the HDD (storage) 33.

4. Image Quality Degradation Suppression Control

Figure 4:
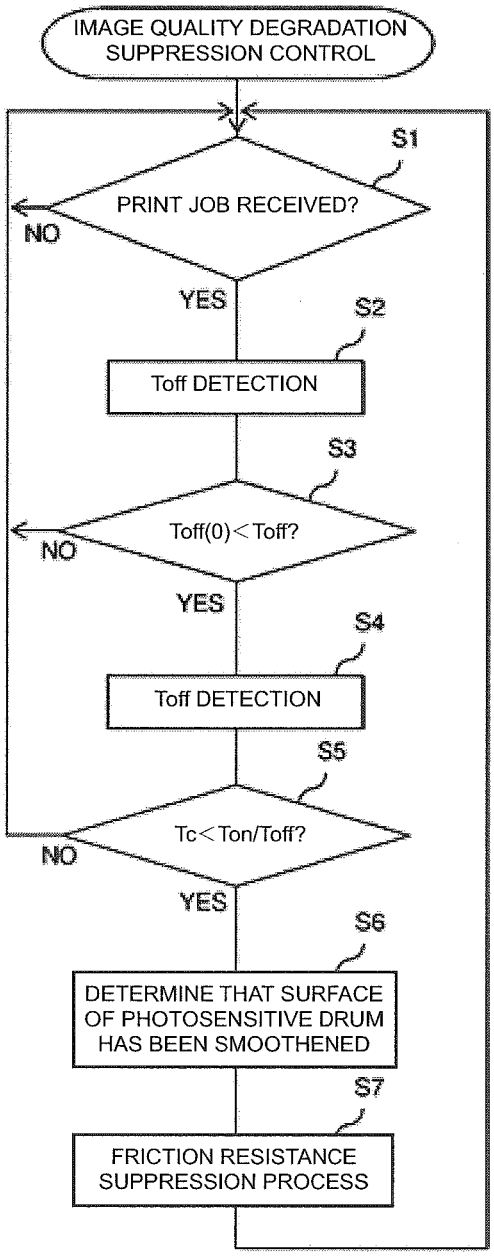
FIG. 4 is a flow chart showing the content of the image quality degradation suppression control process in an image forming apparatus 11 according to the embodiment.

FIG. 4 is a flow chart showing the content of the image quality degradation suppression control process performed by the control circuit 30 in the image forming apparatus 11 according to the present embodiment. There is an unillustrated main routine that controls the entire image forming apparatus 11, and the flow shown in FIG. 4 is a subroutine of the main routine. The subroutine shown in FIG. 4 for image quality degradation suppression control starts when the power to the image forming apparatus 11 is turned on.

The control circuit 30 first monitors whether or not a print job is received (step S1). A print job is received through input by a user via a control panel of the image forming apparatus 11 or through input from a PC or the like connected via a communication network such as a LAN or the Internet. When no print job is received (No in step S1), the control circuit 30 continues with monitoring.

When a print job is received (Yes in step S1), the torque detector 37 detects Toff (step S2), and the control circuit 30 checks, by comparing the detected Toff and Toff(0), whether or not Toff(0)<Toff holds (step S3). Here, Toff(0) may be previously detected and stored in the HDD 33 before the image forming apparatus 11 is shipped out of the factory, or may be detected and stored in the HDD 33 when a user uses the image forming apparatus 11 for the first time. Alternatively, Toff(0) may be detected and stored in the HDD 33 every time the photosensitive drum 20 is replaced.

When Toff(0)<Toff does not hold (No in step S3), a return is made to step S1, where monitoring whether or not a print job is received continues. When Toff(0)<Toff holds (Yes in step S3), the torque detector 37 detects Ton (step S4). Then, the control circuit 30 checks whether or not Tc<Ton/Toff holds (step S5). When Tc<Ton/Toff does not hold (No in step S5), a return is made to step S1, where monitoring whether or not a print job is received continues.

When Tc<Ton/Toff holds (Yes in step S5), the control circuit 30 determines that the surface of the photosensitive drum 20 has been smoothened (step S6), then performs a friction resistance suppression process (step S7). Methods for the friction resistance suppression process include increasing the amounts of toner and external additive which the cleaning device 28, when cleaning the surface of the photosensitive 20, feeds thereto as lubricants, and reducing the AC voltage applied to the charging roller 26 by the bias circuit 34.

Thereafter, a return is made to step S1, where the control circuit 30 monitors whether or not a print job is received, and thereafter the same procedure (steps S1 to S7) is repeated. In the flow in FIG. 4, steps S1 to S6 can be taken as a photosensitive drum (image carrying member) surface smoothening determination process.

Increasing the amounts of toner and external additive which the cleaning device 28, when cleaning the surface of the photosensitive drum 20, feeds thereto helps reduce the friction resistance between the cleaning blade 42 and the photosensitive drum 20. Reducing the charging voltage applied to the charging roller 26 helps suppress production of discharge products and attachment of the produced discharge products to a photosensitive layer, and thus helps suppress the rise in the friction resistance between the cleaning blade 42 and the photosensitive drum 20.

As a result, it is possible to suppress occurrence, in the cleaning blade 42, of chatter, breakage (wear) in an edge part, and stick-slip. An effect of making it easy to remove toner and external additive when the cleaning blade 42 cleans, and an effect of reducing the amount of external additive slipping through a gap between the surface of the photosensitive drum 20 and the cleaning blade 42 can also be expected.

In this embodiment, by checking not only whether or not Tc<Ton/Toff holds but also whether or not Toff(0)<Toff holds, it is possible to prevent the surface of the photosensitive drum from being mistakenly determined to have been smoothened when Tc<Ton/Toff happens to hold temporarily due to some factor at an early stage of use, that is, when the photosensitive drum has not yet been smoothened.

As described above, according to the image forming apparatus 11 of the present embodiment, whether or not the surface of the photosensitive drum (image carrying member) 20 (surface of the photosensitive layer) has been smoothened is checked by use of the torque of the driving motor 36 which drives the photosensitive drum 20. When the relations Toff(0)<Toff and Tc<Ton/Toff hold, it is determined that the surface of the photosensitive drum 20 has been smoothened. The image forming apparatus 11 detects a torque by use of the means for detecting the torque of the driving motor 36 for the purpose of preventing the driving motor 36 from being damaged. Thus, with no additional device, it is possible to check whether or not the surface of the photosensitive drum 20 has been smoothened; this contributes to cost containment. When it is determined that the surface of the photosensitive drum 20 has been smoothened, the friction resistance suppression process is performed to suppress the friction resistance between the cleaning blade 42 and the surface of the photosensitive drum 20 so as to suppress occurrence of chatter, breakage, and stick-slip in the cleaning blade 42. This helps suppress slipping-through of external additive and helps suppress image quality degradation.

MODIFIED EXAMPLES

While a specific example of an image forming apparatus 11 embodying the present disclosure has been described above, this is in no way meant to limit the present disclosure, which thus allows for, for example, modifications as noted below. The embodiment can be combined with a modified example, and a modified example can be combined with another. The present disclosure encompasses any example not described as an embodiment and any design change within the spirit of the present disclosure.

Modified Example 1

The method for detecting the torque of the driving motor 36 is not limited to one that involves detecting the output current from the driving motor 36; instead, the torque of the rotary shaft of the driving motor 36 may be directly detected by a torque sensor.

Modified Example 2

The predetermined torque value Tc is not limited to one that is previously set and stored in the HDD 33; it may instead be, for example, one that is calculated and stored in the HDD 33 after the start of use based on the values of Toff and Ton, or the value of any other factor having an influence on smoothness of the surface of the photosensitive drum 20, detected at the start of use.

Modified Example 3

The storage in which the predetermined torque value Tc is stored is not limited to an HDD 33. When the predetermined torque value Tc is previously set before factory shipment, it may be stored in the ROM 31. In this case, the ROM 31 serves as a storage.

Modified Example 4

The friction resistance suppression process is not limited to one that involves increasing the feeding amount of toner and external additive and one involving reducing the charging voltage. Instead, for example, the biasing force with which the cleaning blade 42 is pressed against the surface of the photosensitive drum may be reduced, or a lubricant other than toner and external additive may be fed. In the latter case, it is necessary to choose a lubricant that has no adverse effect on image formation.

The present disclosure is applicable to image forming apparatuses provided with an image carrying member that has a toner image formed on its surface. Based on the present disclosure, it is possible to provide an image forming apparatus that can detect the degree of smoothness of the surface of the image carrying member by exploiting variation in the torque of a driving device that drives the image carrying member, hence with no additional detecting means.

What is claimed is:

1. An image forming apparatus comprising:

an image carrying member on a surface of which a toner image is formed;

a driving device for driving the image carrying member to rotate;

a charging member for electrostatically charging the image carrying member;

a cleaning member arranged in contact with the surface of the image carrying member for cleaning the surface of the image carrying member;

a voltage applying device for applying a charging voltage to the charging member;

a torque detector for detecting a torque of the driving device when the driving device drives the image carrying member to rotate;

a storage for storing a predetermined torque value Tc which relates to a torque of the image carrying member and which is a constant larger than one; and a control portion for checking condition of the surface of the image carrying member based on the torque of the driving device detected by the torque detector, wherein the control portion obtains as Ton the torque detected by the torque detector when the charging voltage is applied and obtains as Toff the torque detected by the torque detector when no charging voltage is applied, and let the torque observed when no charging voltage is applied at an early stage of use of the image carrying member be represented by Toff(0), then, when relations Toff(0)<Toff and Tc<Ton/Toff hold, the control portion determines that a degree of smoothness of the surface of the image carrying member is equal to or higher than a predetermined degree of smoothness.

2. The image forming apparatus of claim 1, wherein when the control portion determines that the degree of smoothness of the surface of the image carrying member is equal to or higher than the predetermined degree of smoothness, the control portion performs a friction resistance suppression process to reduce a friction resistance between the surface of the image carrying member and the cleaning member.

3. The image forming apparatus of claim 2, further comprising:

a developing device which develops into a toner image the electrostatic latent image formed on the surface of the image carrying member by attaching thereto toner containing abrasive particles, wherein the control portion performs the friction resistance suppression process by feeding toner from the developing device to the image carrying member when image formation is not performed.

4. The image forming apparatus of claim 3, wherein the control portion increases an amount of toner fed from the developing device to the image carrying member as the degree of smoothness of the surface of the image carrying member increases.

5. The image forming apparatus of claim 1, wherein the voltage applying device applies the charging voltage having an AC voltage and a DC voltage superimposed on each other to the charging member, and the control portion performs the friction resistance suppression process by reducing the AC voltage applied from the voltage applying device to the charging member during image formation.

6. The image forming apparatus of claim 5, wherein the charging member is arranged in contact with or close to the surface of the image carrying member.

7. The image forming apparatus of claim 1, wherein the torque detector detects an output electric current value of the driving device required to drive the image carrying member to rotate.

8. The image forming apparatus of claim 1, wherein on the surface of the image carrying member, an amorphous silicon photosensitive layer is formed.

* * * * *